United States Patent [19]

Castanier

[11] 4,311,222

[45] Jan. 19, 1982

[54] SUITCASE WITH ROLLERS

[75] Inventor: Philippe Castanier, Geneuille, France

[73] Assignee: Superior, S.A., France

[21] Appl. No.: 193,270

[22] Filed: Jan. 25, 1980

[30] Foreign Application Priority Data

May 26, 1978 [FR] France ..... 78 16941

[51] Int. Cl.[3] ..... A45C 5/14

[52] U.S. Cl. ..... 190/18 A; 280/47.26

[58] Field of Search ..... 190/18 A, 18 R, 58 B, 190/57; 280/47.26, 47.24, 47.17, 47.13 R, 37, 35

[56] References Cited

U.S. PATENT DOCUMENTS

| | | | |
|---|---|---|---|
| 362,868 | 5/1887 | Roberts | 280/47.26 X |
| 2,416,752 | 3/1947 | Hendrick | 190/18 A X |
| 2,925,283 | 2/1960 | Stilger | 190/18 A X |
| 3,229,991 | 1/1966 | Tessler | 280/47.26 |
| 3,717,228 | 2/1973 | Blair | 190/18 A X |
| 3,799,568 | 3/1974 | Hager | 190/18 A X |
| 3,948,365 | 4/1976 | Gregg | 190/18 A |
| 4,026,570 | 5/1977 | Feinberg | 190/18 A X |

FOREIGN PATENT DOCUMENTS

| | | | |
|---|---|---|---|
| 2005520 | 9/1971 | Fed. Rep. of Germany | 190/18 A |
| 2356011 | 6/1974 | Fed. Rep. of Germany | 190/18 A |
| 1292341 | 3/1962 | France | 190/18 A |

*Primary Examiner*—Donald F. Norton

*Attorney, Agent, or Firm*—Robert E. Burns; Emmanuel J. Lobato; Bruce L. Adams

[57] ABSTRACT

Suitcase comprising two shells (1,2) assembled on one side by a hinge and on the other side by gripping (5,5') (6,6') and lockable closure means. One of the edges (10) perpendicular to the hinge is provided with rolling means (11,12) allowing to move it into two different positions, one of them being almost flat so that the side faces are strongly tilted relative to the rolling plane, the other position being such that the suitcase may almost rest edgewise. Rollers (11,12,21,22) are sunk into alveolus (12,13) containing a support (14) for the axis (15) of said roller. These supports (14) may be separated from the alveolus (13) by pushing on the small tongues (140). The suitcase comprises two handles (5,6) of which at least one allows to hold it on the rollers thereof. The handle (5,6) pivots about two axes (52) set into the side walls of the housing (50); each of the ends of the branches (53,54) comprises a boss (530,540) which fits into a corresponding recess of the housing (50). The folded handle is fully contained in the housing therefore, and in the turned up position it abuts against the wall (51).

7 Claims, 8 Drawing Figures

FIG. 1
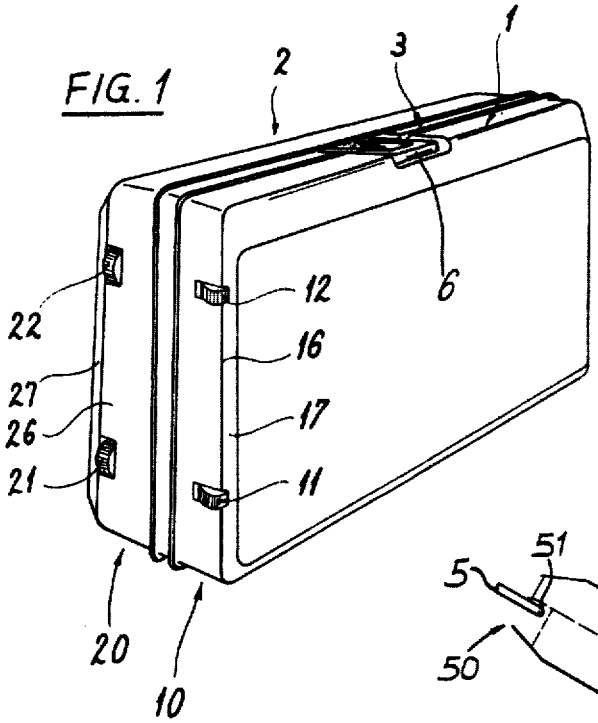
FIG. 1b
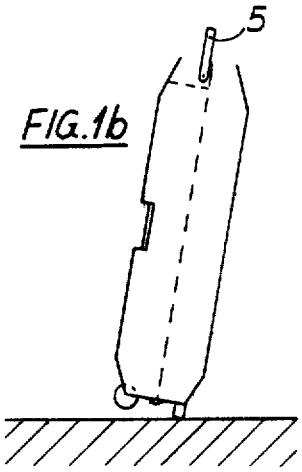
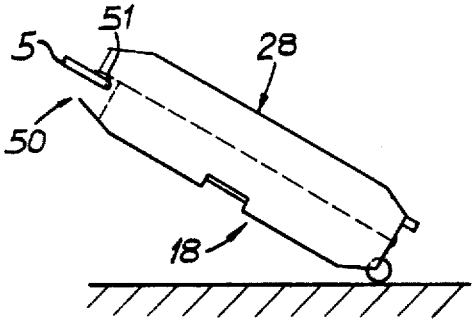
FIG. 1a
FIG. 1c
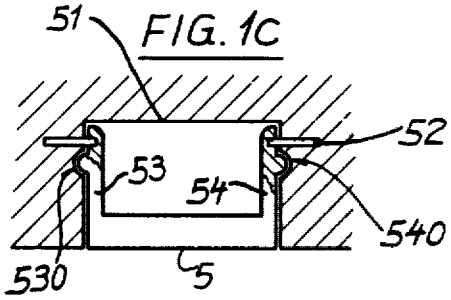
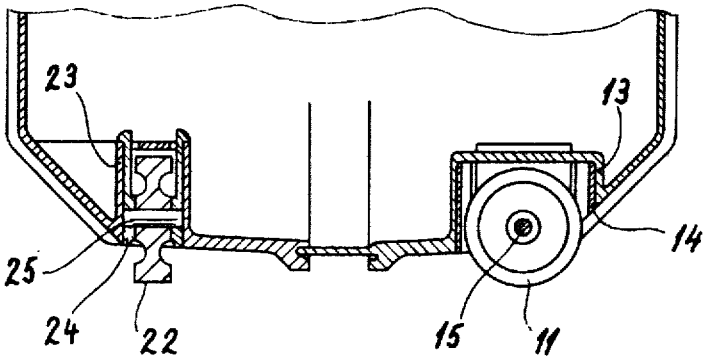
FIG. 2

SUITCASE WITH ROLLERS

FIELD OF INVENTION

This invention relates to hand luggage and more particularly to suitcase comprising two shells assembled on one side by hinge means and on the other side by gripping and locking means.

BACKGROUND OF INVENTION

In this domain many types of luggage made of thermosetting or injectable plastics are known. The factor limiting the dimensions of suitcase of this character is the weight, both of the container and of the contents, for meeting the requirements imposed by the forwarding agent, for example by air, and those resulting from the user's capacity to easily move his suitcase between the departure point and the arrival point of public or private transport means.

When the size of a suitcase becomes relatively large so that its capacity meets the many impediments to be enclosed therein, the problem arises of its transfer to the transport means utilized, notably in railway stations or airports.

In countries where the travellers' comfort is taken into consideration, caddies are put at the public's disposal. There are also devices provided with detachable or fixed rollers, but in addition to their cumbersomeness and their weight, the convenience of their use is not always obvious.

SUMMARY OF INVENTION

The scope of the invention consists in providing suitcase comprising readily available built-in rolling means, of which the weight and overall dimensions are as reduced as possible while permitting of making the suitcase roll either nearly flat or on edge.

To this end, the suitcase according to the invention is characterized by the fact that one of its edges perpendicular to the hinge is provided with rolling means permitting a movement in two different positions, one with the suitcase disposed nearly flat so that its lateral faces be strongly inclined in relation to the ground surface, the other so that the suitcase remains almost on edge.

The principle advantages offered by this suitcase lie in that fact that it is possible to make it roll on a smooth ground in two positions nearly perpendicular to each other, to stop the suitcase in a vertical position on the carrier edge—the rolling directions neutralizing each other—the rolling device constituting an insulating means on a rain-wetted revetment.

Since the rolling means are incorporated in the suitcase they can operate instantaneously without any preparation or adjustment, both in the corridor of a railway car and on the platform of a railway station, on a carpet or on any floor lining. Their intrinsic weight is negligible.

BRIEF DESCRIPTION OF DRAWINGS

Other advantages will appear from the description of preferential but not limiting forms of embodiment, and from the drawing in which:

FIG. 1 is a perspective view of a suitcase in accordance with the invention, FIG. 1*a* is a schematic side view of the suitcase on one set of rollers, FIG. 1*b* is a schematic side view of the suitcase on another set of rollers, FIG. 1*c* is a detail cross section showing a handle construction, FIG. 2 illustrates a section of the rolling means.

FIG. 1 illustrates an exemplary form of embodiment in which the suitcase consists of two shells 1,2 assembled on a frame 3, said frame being unnecessary when the shells are rigid. The shells are assembled, in the absence of a frame, by a hinge on one side, and gripping means on the opposite side.

Figure 3:
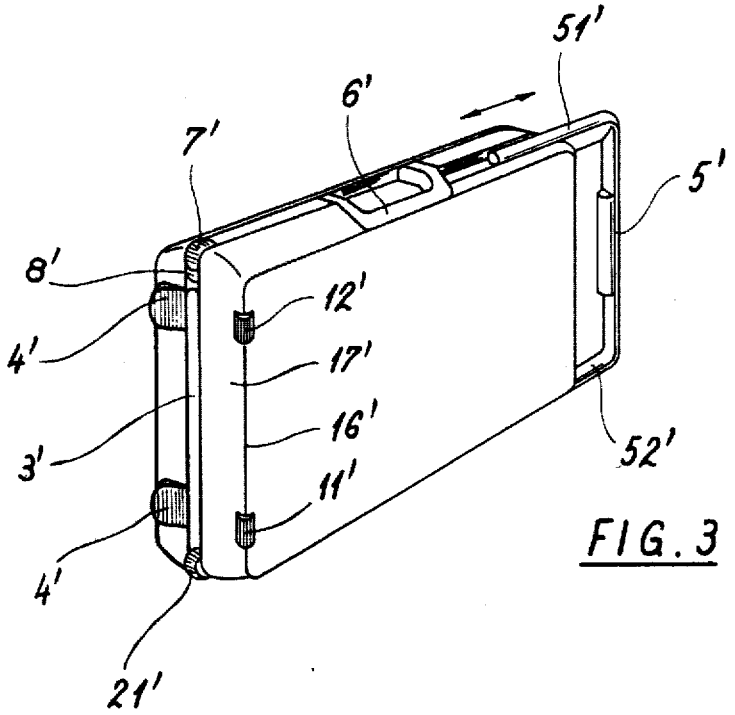
FIG. 3 is a modified form of embodiment.

On one of the edges 10 of shell 1, which is perpendicular to the hinge, flat-rolling means are provided which consist of a pair of rollers 11,12 partially recessed in shell 1.

On one of the edges 20 of shell 2, which is perpendicular to the hinge, on-edge rolling means are provided which consist of a pair of rollers 21,22 partially recessed in the shell 2.

DESCRIPTION OF PREFERRED EMBODIMENTS

FIG. 2 shows that the rollers 11,12 are recessed in alveolus 13 containing a support 14 for the wheel axis 15, said support 14 being adapted to be detached from the alveolus 13 to permit the removal of the flat-rolling means. The axes 15 of rollers 11,12 are aligned parallel to the edge 16 of shell 1 consisting of a cut-off corner 17 in the case described, which facilitates the flat rolling, i.e. with the lateral sides 18,28 strongly inclined with respect to the ground surface (FIG. 1*a*).

The rollers 21,22 are also recessed in alveolus 23 containing each a support 24 for their axes 25. The supports 24 may be detached from their alveolus 23 in order to permit the removal of the on-edge rolling means. The axes 25 are parallel to each other and are perpendicular to the edge 26 of shell 2 formed with a cut-off corner 27 in the case described.

The level of axes 25 in relation to the outer surface of side 20 is so calculated that the rollers 21,22 protrude sufficiently to permit the movement of the suitcase on edge, for example in a railway car corridor (FIG. 1*b*).

The gripping means consist of a handle normally disposed on the edge opposite the one provided with the hinge, in a recess enclosing it completely in its folded position and enabling this handle to cover the locking device of a suitcase closing lock.

To facilitate the handling of the suitcase on its rollers, both in the "flat" position (FIG. 1*a*) and in its "on edge" position (FIG. 1*b*) an additional handle 5 is provided on the edge parallel to, and opposite, the one 10,20 carrying the rollers 11, 12,21,22.

This handle 5 is disposed in a housing 50 into which it collapses completely in its inoperative position. The bottom 51 of this housing constitutes a bearing wall when the handle 5 is in its operative position for it abuts this wall and thus permits of keeping the suitcase on its rollers either in the "flat" position or in the "on-edge" position.

All the suitcase handles are provided with a device (FIG. 1*c*) adapted to hold them in their housing when folded in order to prevent damage likely to result from an untimely unfolding movement due to vibration, for example in a luggage-room.

The handle 5 pivots about two axes 52 housed in the lateral walls of housing 50, the pivot axis being located in the vicinity of the pivoting end of branches 53,54 of the handle. Each one of these ends comprises a boss 530,540 fitting in at least one corresponding depression formed in the lateral walls of housing 50, so that when the handle is folded completely in said housing, or is in the operative position, the bosses pressed by the elasticity of branches 53,54 into engagement in the corresponding depressions prevent this handle from pivoting about its pivot axes 52.

FIG. 3 illustrates a modified form of embodiment in which the flat rolling means consist of rollers 11', 12' having a common axis of rotation parallel to the edge 16' of cut-off corner 17'.

The on-edge rolling means consist of a single roller 21' disposed on one corner of frame 3'.

To permit the keeping in a position of stable equilibrium on edge of this suitcase, two stabilizing studs 4' are positioned to register with rollers 11', 12', on the other side of frame 3'.

To maintain the equilibrium of the suitcase in case of on-edge rolling, a collapsible handle 5' is slidably mounted on the frame and can be gripped on the edge opposite the one supporting the roller 21'. This handle being U-shaped with a long bar and two branches 51' and 52' on the two long sides of the frame may be gripped with both hands, for it has the same width as the suitcase, its side branches 51',52' being retained in slideways secured to the frame.

A collapsible handle 6' conceals a locking mechanism without protruding when the suitcase is handled by using the collapsible handle 5'.

The locking device is controlled by a corner 7' lock detect means pivoting, for opening or closing the suitcase, about pivot means disposed at the center of a hypotenuse of the right angle formed by said corner. A lock tell-tale device 8' shows whether the lock detent means is effective or not.

In another modified embodiment the on-edge rolling means consist of a pair of rollers disposed at each corner of a small edge of the suitcase, on either side of the frame. In this form of embodiment the suitcase has no cut-off edges, unless one support of the roller axis is disposed inside the corners supporting them.

Figure 4:
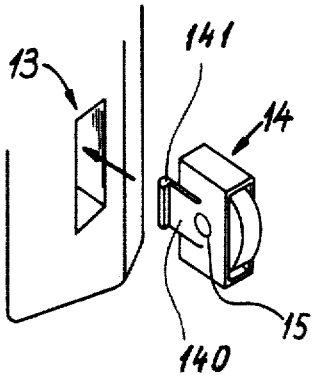
FIGS. 4 and 5 illustrate details of the rolling means.
Figure 5:
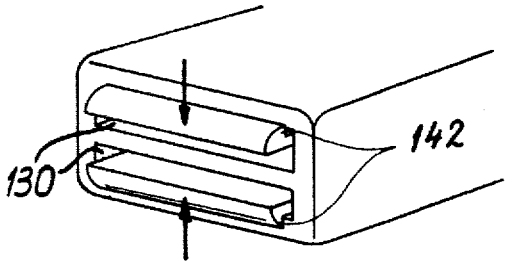

FIG. 4 shows how the rolling means are detachable. The support 14 of axis 15 is a box comprising a peripheral ledge and lugs 140 projecting beyond the box bottom and comprising at their free flexible ends a bevelled bead 141.

The support 14 is introduced into an alveolus 13,23 of the suitcase, the bottom of this alveolus comprising two rectangular apertures 130 having substantially the same dimensions as the bead 141. The bevelled shape of said bead and its shoulder 142 are such that the support 14 can be secured within the alveolus 13.

To remove this support from its alveolus it is necessary to open the suitcase and press the beads 141 inwards towards each other until they can pass again through the apertures 130.

I claim:

1. A suitcase comprising a shell having a plurality of roller-receiving sockets, and rollers removably held in said sockets, each of said rollers being rotatable on an axis extending between opposite side walls of a box fitting into a said socket and having a periphery comprising said side walls, and flexible tongues provided on side walls of said box and having bevelled beads at their free ends, said socket having openings to receive and retain said beads to retain said box with its roller in said socket, said box being releasable from said socket by lateral flexing of said tongues to displace said bevelled beads to free them from said openings.

2. A suitcase according to claim 1, in which said openings open to the inside of the suitcase to provide access to said beads to press them towards each other to release said box.

3. A suitcase according to claim 1 or 2, in which said shell on a side opposite said rollers has a recess with a rear wall, and in which a handle is pivotally mounted in said recess for pivotal movement between a stored position in said recess and an operative position projecting from said shell, said handle abutting said rear wall of the recess to limit its pivotal movement when it is moved to its operative position.

4. A suitcase according to claim 3, in which said handle comprises a hand-grip portion and two branches at opposite ends of said hand-grip portion and pivotally connected with said shell at opposite sides of said recess, at least one of said branches having a projecting boss near the pivot axis resiliently engageable in said recess to retain said handle in stored position.

5. A suitcase according to claim 4, in which a depression is provided in a side of said recess in position to receive said boss when said handle is in stored position.

6. A suitcase comprising a shell, a plurality of rollers on one side of said shell, a recess in a side of said shell opposite said rollers and having a rear wall, and a U-shaped handle comprising a hand-grip portion and two branches at opposite ends of said hand-grip portion pivotally mounted in said recess for pivotal movement between a stored position in said recess and an operative position projecting from said shell, said branches of said handle abutting said rear wall of the recess to limit pivotal movement of the handle when moved to its operative position.

7. A suitcase according to claim 6, in which a boss on at least one of said branches near the pivot axis resiliently is engageable in a depression in a side of said recess to retain said handle in stored position.

* * * * *